United States Patent [19]

Reuss et al.

[11] Patent Number: 4,701,740

[45] Date of Patent: Oct. 20, 1987

[54] RHEOSTATIC DEVICES

[75] Inventors: Oswald Reuss, Unterelsbach; Franz Rutterschmidt, Heustreu, both of Fed. Rep. of Germany

[73] Assignee: Preh Elektrofeinmechanische Werke Jakob Preh Nachf. GmbH & Co., Bad Neustadt/Saale, Fed. Rep. of Germany

[21] Appl. No.: 802,721

[22] Filed: Nov. 27, 1985

[30] Foreign Application Priority Data

Nov. 30, 1984 [DE] Fed. Rep. of Germany ..... 3444229

[51] Int. Cl.[4] ..... H01C 10/32

[52] U.S. Cl. ..... 338/164; 338/152; 338/163

[58] Field of Search ..... 338/164, 152, 163, 162, 338/174, 128, 123, 129, 130, 131, 132

[56] References Cited

U.S. PATENT DOCUMENTS 2,177,285 10/1939 Schellenger ..... 338/163
3,723,937 3/1973 Frey, Jr. et al. ..... 338/164 X
4,110,721 8/1978 Nakanishi et al. ..... 338/128
4,430,634 2/1984 Hufford et al. ..... 338/164

OTHER PUBLICATIONS

Krafthand, "Elektronischer Vergaser Serienreif", Aug. 6, 1983, pp. 877-881.

*Primary Examiner*—E. A. Goldberg
*Assistant Examiner*—M. M. Lateef
*Attorney, Agent, or Firm*—Woodcock Washburn Kurtz Mackiewicz & Norris

[57] ABSTRACT

The interior of a rheostatic device, such as a throttle-valve position potentiometer having a rotor with sliding spring contact and a housing exposing at least one end of the rotor for operation, is sealed off against environmental effects by at least two hollow cylindrical rotor walls which are located concentrically within each other and extend towards a lid attached to a bottom part of the housing and at least two hollow cylindrical walls of said lid which are concentrically disposed within each other and extend between the rotor walls.

20 Claims, 4 Drawing Figures

RHEOSTATIC DEVICES

FIELD OF THE INVENTION

The present invention pertains to rheostatic devices, particularly, rotary devices housed for operation in deleterious environments.

BACKGROUND OF THE INVENTION

A rheostatic positional transducer protected for use with automotive engines is described in U.S. Patent specification No. 4,430,634. Such a rheostatic device is used, e.g., in an electronic carburetor of a motor vehicle. An article in the German publication Krafthand, No. 15, Aug. 6, 1983, pp. 877–881 describes generally such a use. The fuel-air ratio of the mixture is electronically controlled during start, cruising and acceleration. The fuel-air ratio is influenced by means of a start flap. A second servo component controls the throttle valve. A throttle-valve potentiometer, which is connected with the throttle-valve shaft by a coupling, is used to indicate the position and the movement of the throttle valve.

It is important to protect the resistor layer and the sliding spring contact in such potentiometers from external environmental conditions such as oil, dust, gasoline, exhaust gases, etc.

SUMMARY OF THE INVENTION

It is an object of the present invention to protect the internal space of the housing of such a device in which the resistor and collector members are disposed from deleterious environmental elements such as oil, gasoline, dust and exhaust gases.

It is another object to prevent the penetration of environmental elements into the recess of a housing receiving and supporting a rotor wherein the housing is provided with an opening to access the rotor.

The above objects and others are solved according to the present invention by the provision of a housing including a bottom part with a recess and a lid mating with the bottom part covering the recess. A rotor is positioned in said recess and rotationally supported by the bottom piece. A transducer is provided in the recess by means of a resistor element and a collector element bridged by spring contacts carried by the rotor, thereby generating a signal indicating angular position of the rotor. The rotor is exposed through an opening in the lid for coupling with a rotary actuator. An important aspect of the invention is the provision of two or more concentric wall elements extending from an inner side of said lid into said recess and two or more concentric wall elements extending from an end of the rotor towards the lid. The sets of wall elements are concentric with respect to one another and the axis of rotation of the rotor and extend among one another.

Further according to the described embodiments of the invention, two lid walls extend between two of the rotor walls and provide a space for receiving a coil spring attached at one end to the lid and at another end to the rotor for positioning the rotor. The innermost lid wall is higher (i.e. extends axially farther than the remaining lid wall(s)). So too for the inner-most rotor wall with respect to the remaining rotor wall(s). Preferably the axial overlay between adjoining lid and rotor walls is greatest between the innermost lid wall and innermost rotor wall. Preferably too, an edge portion of the lid is provided between the innermost lid wall and the lid opening and overlaps the free end of the innermost rotor wall.

According to another important aspect of the invention the rotor includes an intermediate support member angularly adjustable with respect to the remainder of the rotor, in particular the rotor walls, through the lid opening.

Through this invention, the housing is protected against environmental effects in a practically sealed manner from the side from which the rotor is rotatable. Thus, if the rheostatic device is used as a throttle-valve potentiometer, the interior of the device is sealed against dust, gasoline, oil and exhaust gases that may be present.

Other advantages and embodiments of the present invention will appear or be suggested from the following description and claims and the accompanying drawings.

DETAILED DESCRIPTION OF THE INVENTION

Figure 1:
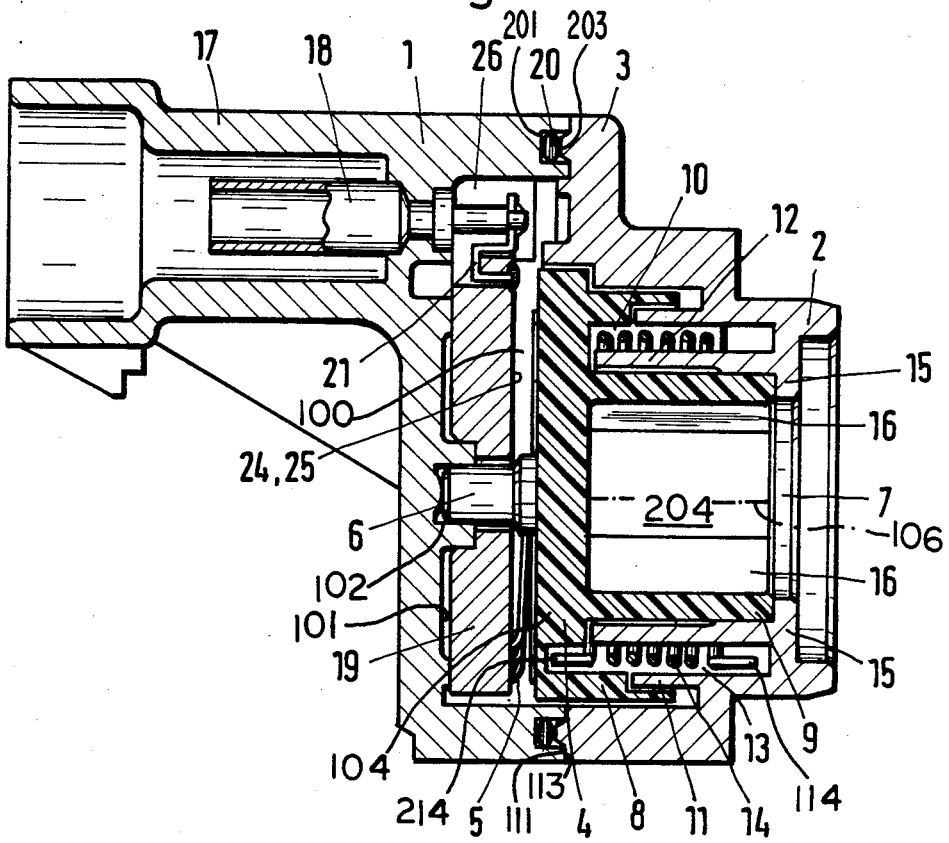
FIG. 1 is a longitudinal sectioned side of a rheostatic device of the invention adapted for uses as a throttle valve actuated potentiometer.
Figure 2:
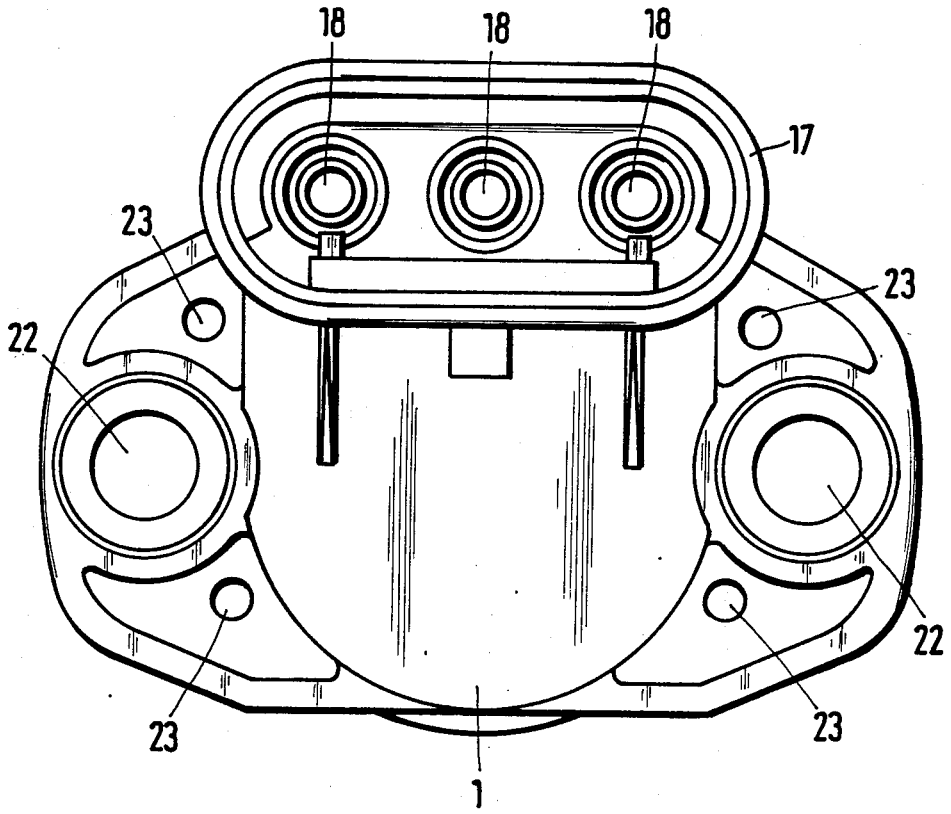
FIG. 2 is a "rear" view of the rheostatic device according to FIG. 1.
Figure 3:
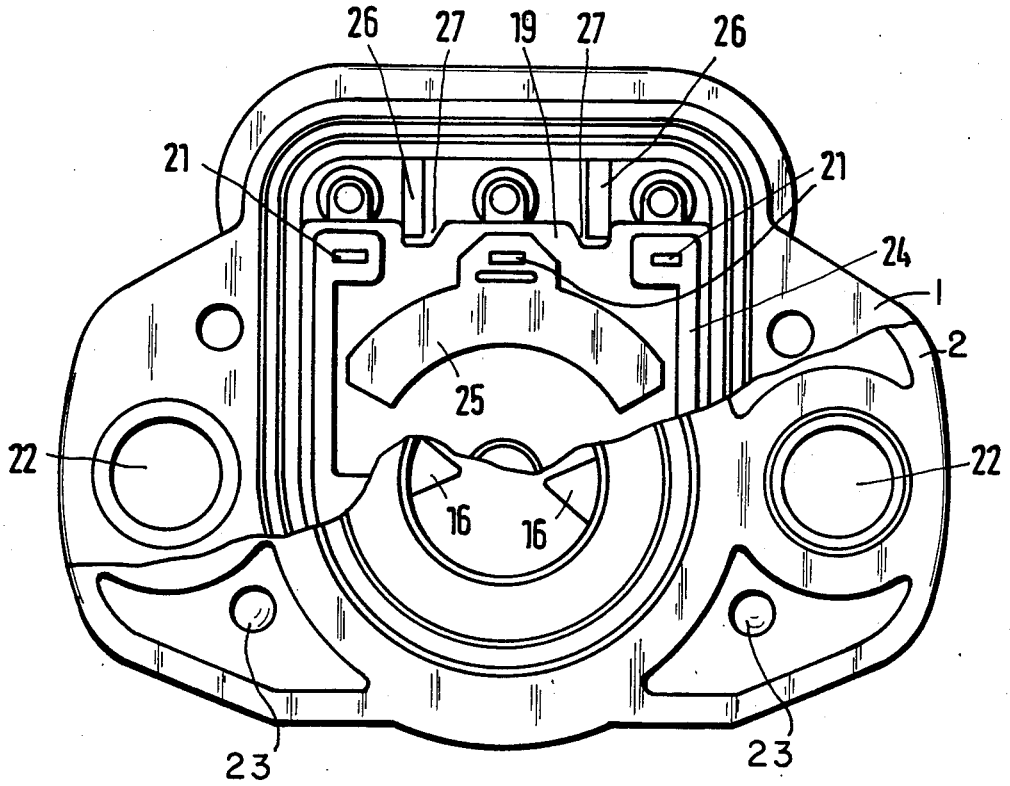
FIG. 3 is a partially section "front" view of the rheostatic device according to FIG. 1.

FIGS. 1–3 depict the first preferred embodiment of the invention. Referring to FIG. 1, a hollow or cupped lid 2 having an outer circumferential (ring-shape) wall 3 mates with a hollow housing bottom part 1 having a cupped recess 100. Facing flange surfaces 101 and 103 of the bottom part 1 and lid 2, respectively, mate with one another. The surfaces 101 and 103 are interrupted by a female recess 201 and a male protrusion 203, respectively, for centering the lid 2 to on the bottom part 1. A packing ring 20 in the recess 201 provides a further seal between the two elements 1 and 2 at their outer peripheries.

Referring to FIG. 1, a rotor 4 is positioned in the recess 100 between the bottom part 1 and lid 2. The rotor 4 is rotatably mounted by means of a shaft 6 extending from one side of a base portion 104 of the rotor and received in a pivot bearing 102 provided in the bottom 101 of the recess 100. The rotor 4 is supported and guided on its opposing side in a manner to be described. The lid has a central opening 7 through which the rotor 4 is accessed for rotation.

Projecting from said opposing side of the base portion 104 of the rotor 4 towards the lid 2, are two, hollow, cylindrical rotor walls 8 and 9. The rotor walls 8 and 9 are integral with the base portion 104 of the rotor and are concentrically arranged with respect to each other and the axis of rotation 106 of the rotor 4. Obviously, the outer rotor wall 8 has a larger, cylindrical diameter that does the inner rotor wall 9. An annular or ring shaped space 10 is provided between the two rotor walls 8 and 9 for receiving a pair of spaced, hollow, cylindrical lid walls 11 and 12 concentrically positioned with respect to one another and the axis 106. The walls 11 and 12 are integral with the remainder of the lid 2 and extend from an interior side of the lid 2 towards the bottom 101 of the recess and into the ring shape space 10 provided between the rotor walls 8 and 9. The outer lid wall 11 has a larger cylindrical diameter than does the inner lid wall 12. For rotational support and sealing, the outer surface of the inner rotor wall 9 is in circumferential contact over part of its axial length with a circumferential part of the facing inner surface of the inner lid wall 12.

A coil spring 14 is positioned in a ring-shaped space 13 between the two lid walls 11 and 12. One end 114 of the spring 14 is attached to the lid 2 and the other end 214 is attached to the rotor 4. The spring 14 is tensioned or compressed by rotation of the rotor from a rest position and serves to reset the rotor to the rest position when rotational force is removed from the rotor. The inner rotor wall 9, with the smaller diameter, is higher (i.e. extends farther from the base 104 of the rotor 4 into the lid 2) than does the outer rotor wall 8, with the larger diameter. The inner lid wall 12, with the smaller diameter, is higher (i.e. extends farther towards the bottom 101 of the recess 100) than does the outer lid wall 11, with the larger diameter. A multiple labyrinth is formed between the rotor 4 and the lid 2 by the walls 8, 9, 12 and 13 intermeshing with each other. The free or extreme end of the inner projecting rotor wall 9 with the smaller diameter is practically sealed by a circular edge section 15 of the lid extending between the central lid opening 7 and innermost lid wall 12 and at least partially overlapping said free end of the innermost rotor wall 9. Only a inner beveled surface portion of the free end of wall 9 is exposed through the opening 7 as is a central cylindrical recess 204 in the interior of the rotor 4 formed by the innermost rotor wall 9 and base 104. To link the rotor 4 with a driving means, a pair of diametrically opposed catches 16 are provided extending radially inwardly from the inner surface of the innermost rotor wall 9 into the recess 204.

As is best depicted in FIG. 3, the lid 2 is affixed to the bottom part 1 by rivets 23. As is further depicted in FIGS. 2 and 3, mounting holes 22 are provided to fasten the housing to a support (not depicted).

Referring now to FIGS. 1 and 2, a projection 17 is formed on housing bottom part 1 on a side opposite the lid 2 and recess 100 and contains plug members 18, three of which are depicted in FIG. 2. Said plug members 18 are connected in an electrically conducting manner with contact members 21 located on an insulating substrate 19 positioned within the recess 100 as is depicted in FIGS. 1 and 3. As seen in FIG. 3, two contact members 21 are electrically connected with a resistor member 24 positioned in the recess and a third contact member 21 is connected with a collector 25, also positioned in the recess 100. Webs 26, which reach into recesses 27 of the substrate 19, are provided on the interior of the recess 100 in the housing bottom part 1. Vapors can hardly penetrate into that portion of the recess 100 in which the substrate 19 is located through the lid opening 7, even where the device is installed in a carburetor and the opening 7 is open toward it as in the case of the throttle-valve potentiometer, because the mounting between the rotor wall 9, the lid wall 12 and its edge section 15 provide for a closure, and the labyrinth of the walls 8, 9, 11, 12 provides for effective spacial separation. At the same time, the coil spring 14 is also protected in the ring-shaped space 13. It is also beneficial in the example according to FIGS. 1 through 3 that it is not necessary to break through the base 104 of the rotor 4 into the opening 7 to accommodate the shaft 6.

Figure 4:
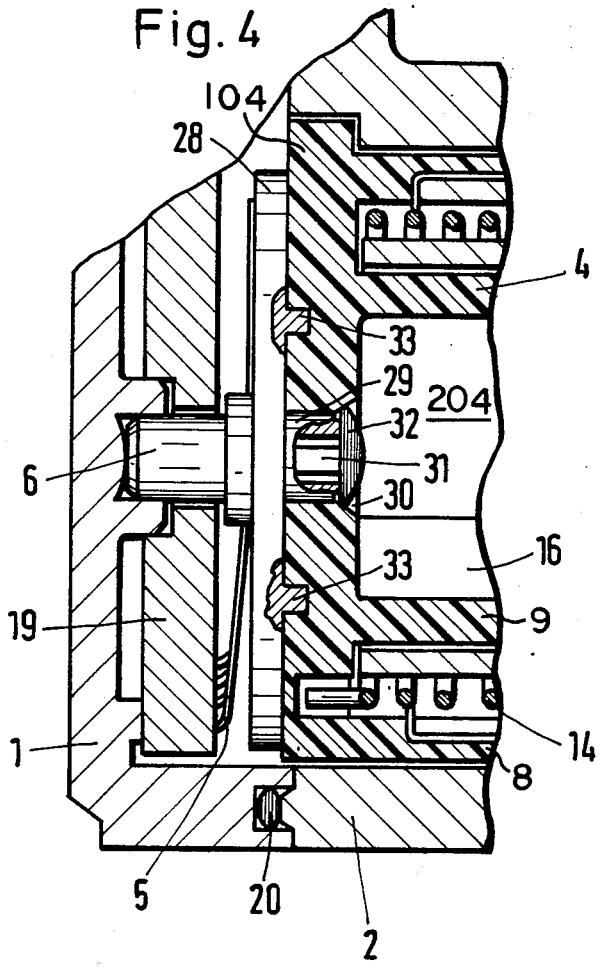
FIG. 4 shows a partial view of another rheostatic device embodiment partially sectioned for clarity.

In the embodiment according to FIG. 4, the sliding spring contact 5 is attached to an intermediate support member 28 whose angular position relative to the body of the rotor 4, particularly the walls 8 and 9, is adjustable. The shaft 6 is attached to the intermediate support member 28. An end 29 of the shaft 6 extends into a central recess 204 of the rotor 4 formed by the inner surface of the innermost rotor wall 9 and base 104 of the rotor. The shaft end 29 is keyed, e.g., with a polygonal recess 31 as shown, a slot or the like, for rotating the shaft end 29 to set the angular position of the intermediate support member 28 and attached contacts 5 relative to the remainder of rotor 4, again, in particular, the keyed rotor wall 9. This embodiment is preferred for use where the sliding spring contact 5 must be adjusted with respect to the reset position of the rotor 4 (i.e. position of catches 16) after the installation of the invention in a given device, e.g., a carburetor. It is now possible to adjust the intermediate support member 28 and hence the sliding spring contact 5 supported on the member 28, relative to the catch 16 of the rotor 4 by means of the polygonal recess 31. Once this adjustment has been completed, the shaft end 29 (and coupled intermediate support member 28 and contacts 5) are fixed to the body of the rotor 4 by suitable means such as a plug 32 of a curable sealing compound. The opening 30 through the rotor base 104 is sealed off by the sealing compound plug 32.

It is also possible to close the opening 30 with a labyrinth seal 33 (see FIG. 4) between the intermediate support member 28 and the base 104 of the rotor 4 by engaging male and female elements, similar to what is shown in FIG. 1 between the rotor 4 and the lid 2, along the outer periphery of both pieces. Sealing can also be achieved by other conventional means of fixing the intermediate support member 28 on the rotor 4, e.g., with an adhesive or sealing layer.

While several embodiments have been described and variations thereto suggested, the invention is not limited to the described embodiments but is defined by the following claims.

We claim:

1. A rheostatic device comprising a housing bottom part with a cupped recess, a resistor member with two contact members positioned in said recess, a collector member with a third contact member positioned in said recess, a cupped lid having a ring-shaped outer circumferential wall configured for mating with said housing bottom part and enclosing said recess, a rotor positioned in said recess between said bottom part and said lid, a pivot bearing in the bottom of said recess, a shaft extending from one side of said rotor and received in said pivot bearing, a projection extending from an opposing side of said rotor to said lid for rotatably supporting said rotor about an axis of rotation, a central opening in said lid for exposing said rotor for actuation from outside the device and a sliding spring contact supported by said rotor for providing an electrical connection between said resistor member and said collector member and characterized in that said projection comprises: at least two projecting, hollow, cylindrical rotor walls with different diameters concentrically arranged around said axis of rotation of the rotor and providing a ring-shaped space therebetween; and said lid further comprises: at least two hollow, cylindrical lid walls concentrically disposed with respect to one another on an inner side of said lid and extending from said inner side of the lid into said space between said pair of rotor walls.

2. The rheostatic device in accordance with claim 1, characterized in further comprising: a coil spring having one end attached to the lid and another end attached to the rotor; and a ring-shaped space formed between the two cylindrical lid walls receiving at least part of said coil spring.

3. The rheostatic device in accordance with claim 1, characterized in that an innermost one of the rotor walls having a smaller cylindrical diameter, is longer than any remaining outer rotor wall having a larger cylindrical diameter.

4. The rheostatic device in accordance with claim 1, characterized in that an innermost one of the lid walls having a smaller cylindrical diameter, is longer than any remaining outer lid wall disposed on an inner side of said lid with a larger cylindrical diameter.

5. The rheostatic device in accordance with claim 1, characterized in that said rotor walls and said lid walls intermesh forming a labyrinth between said central opening and said collector and resistor members.

6. The rheostatic device in accordance with claim 1, characterized in that said lid includes a circular edge section forming the central lid opening and at least partially overlapping a free end of an innermost one of said rotor walls.

7. The rheostatic device in accordance with claim 1, characterized in further comprising a catch extending radially inwardly from an innermost one of said rotor walls having the smallest cylindrical diameter.

8. The rheostatic device in accordance with claim 1, characterized in that said rotor further comprises an adjustable support member supporting said shaft and the sliding spring contact and angularly adjustable with respect to a remainder of the rotor including said rotor walls.

9. The rheostatic device in accordance with claim 8, characterized in that said rotor further comprises: a portion of said shaft coupled with said intermediate support member extending through a base portion of said rotor supporting said rotor walls and having an end accessible through said lid opening and an opening in said shaft end for adjustment of angular position of the intermediate support member with respect to said base portion of the rotor; and a sealing element covering said opening and fixing said intermediate support member to said base portion of the rotor.

10. A rheostatic device protected against exterior contaminates comprising:

a housing bottom piece having a recess;

a lid positioned over said recess and sealingly mating with said housing bottom piece;

a rotor having a plurality of projecting concentric, cylindrical rotor walls extending from an end of said rotor facing said lid positioned in said recess, said rotor being rotationally supported by said housing bottom piece;

electrical transducer means in said recess for generating a signal indicating the angular position of said rotor;

a central opening through said lid; and a plurality of spaced, concentric, cylindrical wall elements extending from an inner side of said lid into said central recess and surrounding the central opening through said lid;

wherein said projecting rotor walls receive said lid walls for rotatably supporting said rotor from said lid and for forming a labyrinth between said central lid opening and said electrical transducer means.

11. A rheostatic device protected against exterior contaminants comprising:

a housing bottom piece having a recess;

a lid position over said recess and sealingly mating with said housing bottom piece;

a rotor positioned in said recess and rotationally supported by said housing bottom piece;

electrical transducer means in said recess for generating a signal indicating the angular position of said rotor;

a central opening through said lid;

a first plurality of spaced, concentric, cylindrical wall elements extending from an inner side of said lid into said central recess and surrounding the central opening through the lid; and a second plurality of spaced, concentric, cylindrical wall elements extending from an end of said rotor facing said lid and among said first plurality of concentric, cylindrical wall elements for rotatably supporting said rotor from said lid and for forming a labryinth between said central lid opening and said electrical transducer means;

wherein at least one circumferential portion of at least one wall element of the first plurality contacts a circumferential portion of one wall element of the second plurality for rotationally supporting said rotor.

12. The device of claim 11 further comprising:

an edge portion of said lid extending between an innermost one of said first plurality of concentric, cylindrical wall elements and said central opening and overlapping at least a portion of a free edge of an innermost one of said second plurality of concentric, cylindrical wall elements.

13. The device of claim 12 wherein said innermost wall elements of the first and second pluralities of concentric wall elements axially overlap one another more than do any other overlapping pair of wall elements of said first and second pluralities of concentric wall element.

14. The device of claim 13 further comprising keying means on said rotor within said innermost cylindrical wall of said first plurality of concentric wall elements for coupling said rotor to a rotational member passed through said central lid opening.

15. In a rheostatic positional transducer including a plurality of electrical contacts, a rotor rotatably supported about an axis of rotation for contacting said electrical contacts to indicate angular rotor position, a housing enclosing and protecting said electrical contacts and said rotor, and an opening through one side of said housing along an axis of rotation of the rotor for receiving a rotational member to drive said rotor, the improvement comprising:

a first plurality of concentric, cylindrical wall elements extending from an end of said rotor facing said opening and surrounding said opening; and a second plurality of concentric, cylindrical wall elements surrounding said opening and extending from said housing concentrically into said first plurality of wall elements forming a labyrinth therewith between an innermost one of said first and second pluralities of wall elements and an outermost one of said first and second pluralities of wall elements.

16. The transducer of claim 15 wherein at least one of said first plurality of concentric wall elements extend at least half the axial length of said rotor.

17. The transducer of claim 15 wherein only a free end portion of one of said first plurality of concentric wall elements contacts a concentric wall element of the second plurality.

18. The transducer of claim 17 wherein two wall elements of the first plurality are separated by a cylindrical space receiving at least two wall elements of the second plurality.

19. The transducer of claim 15 wherein an innermost one of said first plurality of concentric wall elements forms a recess for receiving said rotational member and includes at least one catch means for keying said rotor with said rotational member.

20. The transducer of claim 19 wherein said plurality of electrical contacts includes a resistor element and a collector element and said improvement further comprises:

an intermediate support member of said rotor carrying spring contact means for bridging said resistor element and said collector element and rotatably supported with respect to said concentric wall elements of the first plurality, a portion of said intermediate support member extending into said recess formed by said innermost one of the concentric wall elements of the first plurality for adjustment of the angular position of said intermediate support member with respect to said innermost concentric one of the wall element of the first plurality through said housing opening.

* * * * *